US006860583B2

(12) United States Patent
Cheney et al.

(10) Patent No.: US 6,860,583 B2
(45) Date of Patent: Mar. 1, 2005

(54) WASTE INK ABSORPTION SYSTEM AND METHOD

(75) Inventors: M. Lynn Cheney, Vancouver, WA (US); Thomas E McCue, Jr., Vancouver, WA (US); Jeffrey Dylan Frame, Los Altos, CA (US); Teressa L Roth, Brush Prairie, WA (US); Rowdy Kelvin Webb, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 17 days.

(21) Appl. No.: 10/330,344

(22) Filed: Dec. 27, 2002

(65) Prior Publication Data

US 2004/0125154 A1 Jul. 1, 2004

(51) Int. Cl.[7] ..... B41J 2/165
(52) U.S. Cl. ..... 347/35; 347/31
(58) Field of Search ..... 347/22, 28–36

(56) References Cited

U.S. PATENT DOCUMENTS

| | | | | |
|---|---|---|---|---|
| 4,024,548 A | | 5/1977 | Alonso et al. | |
| 4,306,245 A | | 12/1981 | Kasugayama et al. | |
| 4,682,184 A | | 7/1987 | Terasawa | |
| 4,901,094 A | | 2/1990 | Iwagami et al. | |
| 5,051,758 A | | 9/1991 | Markham | |
| 5,216,450 A | | 6/1993 | Koitabashi et al. | |
| 5,291,227 A | * | 3/1994 | Suzuki | 347/104 |
| 5,300,958 A | | 4/1994 | Burke et al. | |
| 5,329,306 A | | 7/1994 | Carlotta | |
| 5,357,275 A | * | 10/1994 | Ikado et al. | 347/31 |
| 5,557,306 A | | 9/1996 | Fukushima et al. | |
| 5,614,930 A | | 3/1997 | Osborne et al. | |
| 5,644,343 A | | 7/1997 | Allen | |
| 5,896,143 A | * | 4/1999 | Matsui et al. | 347/24 |
| 5,905,514 A | | 5/1999 | Rhoads et al. | |
| 5,907,335 A | | 5/1999 | Johnson et al. | |
| 5,969,739 A | | 10/1999 | Altendorf et al. | |
| 6,019,466 A | * | 2/2000 | Hermanson | 347/104 |
| 6,145,958 A | | 11/2000 | Medin et al. | |
| 6,168,259 B1 | * | 1/2001 | Capurso | 347/36 |
| 6,227,661 B1 | | 5/2001 | Hayakawa | |
| 6,239,817 B1 | * | 5/2001 | Meyer | 347/36 |
| 6,276,778 B1 | | 8/2001 | Katayama | |
| 6,299,279 B1 | | 10/2001 | Asada | |
| 6,337,354 B1 | | 1/2002 | Katsumata et al. | |
| 6,341,837 B1 | | 1/2002 | Jung | |

(List continued on next page.)

FOREIGN PATENT DOCUMENTS

| | | | | |
|---|---|---|---|---|
| DE | 3042998 A1 | | 11/1980 | |
| DE | 3406865 A | * | 8/1985 | B41J/03/04 |

(List continued on next page.)

OTHER PUBLICATIONS

Epson Stylus Photo 820, At–A–Glance, Epson America, Inc., October 2001, 1 page.

(List continued on next page.)

*Primary Examiner*—Shih-Wen Hsieh

(57) ABSTRACT

An inkjet printing system includes a platen adapted to support a print media, a printhead adapted to eject ink into a print zone between the printhead and the platen toward the print media and beyond a first edge of the print media to generate waste ink, a first absorber formed in the platen within the print zone such that the first absorber is adapted to extend beyond the first edge of the print media and absorb the waste ink ejected beyond the first edge of the print media, and a second absorber adapted to contact and absorb the waste ink from the first absorber, wherein the first absorber has a first capillary head and the second absorber has a second capillary head greater than the first capillary head.

37 Claims, 4 Drawing Sheets

U.S. PATENT DOCUMENTS

| | | | | |
|---|---|---|---|---|
| 6,361,142 | B1 | 3/2002 | Otsuka et al. | |
| 6,454,373 | B1 | 9/2002 | Therien et al. | |
| 6,454,374 | B1 | 9/2002 | Therien | |
| 6,481,827 | B2 | 11/2002 | Yearout | |
| 6,491,371 | B1 | 12/2002 | Berg et al. | |
| 6,616,266 | B2 * | 9/2003 | Neal et al. | 347/35 |
| 6,619,783 | B2 * | 9/2003 | Kanaya et al. | 347/35 |
| 2004/0051755 | A1 * | 3/2004 | Kanamitsu et al. | |

FOREIGN PATENT DOCUMENTS

| | | | |
|---|---|---|---|
| EP | 0602646 | A2 | 6/1994 |
| EP | 0673772 | A1 | 9/1995 |
| EP | 0714775 | A2 | 6/1996 |
| EP | 1234676 | | 8/2002 |
| EP | 0901905 | | 9/2002 |
| JP | 60030348 | A | 2/1985 |
| JP | 02011332 | A | 1/1990 |
| JP | 04141440 | A | 5/1992 |

OTHER PUBLICATIONS

Epson Stylus Photo 820, Product Information Guide, Sep. 2001, 10 pages.

HP Photosmart 100 Series Printer, Overview, Hewlett–Packard Co., 2002, 1 page.

US 2004/0051755 A1, "Waste liquid treating device and liquid ejecting apparatus incorporating the same", Kanamitsu et al., filed Jun. 11, 2003, pub. date Mar. 18, 2004, pending.*

Copy of European Search Report Application No. 03257047.5 mailed May 17, 2004.

* cited by examiner

WASTE INK ABSORPTION SYSTEM AND METHOD

BACKGROUND OF THE INVENTION

An inkjet printing system may include a printhead and an ink supply which supplies liquid ink to the printhead. The printhead ejects ink drops through a plurality of orifices or nozzles and toward a print media, such as a sheet of paper, so as to print onto the print media. Typically, the orifices are arranged in one or more arrays such that properly sequenced ejection of ink from the orifices causes characters or other images to be printed upon the print media as the printhead and the print media are moved relative to each other.

In one arrangement, the inkjet printing system produces a borderless image on the print media. More specifically, the inkjet printing system produces an image on the print media without one or more unprinted margins between the image and a corresponding edge of the print media. An example of such an image includes a photograph. Examples of such a borderless inkjet printing system include the HP Photosmart 100 series printer produced by Hewlett-Packard Company of Palo Alto, Calif., assignee of the present invention, and the Epson Stylus Photo 820 printer produced by Seiko Epson Corporation.

Typically, the borderless inkjet printing system produces a borderless image on the print media by ejecting ink drops beyond one or more edges of the print media. As such, overspray or waste ink is generated by the ink drops which are deposited beyond the edges of the print media. Unfortunately, this overspray or waste ink can be transferred to print media subsequently fed through the inkjet printing system and, therefore, negatively affect the quality of images produced with the inkjet printing system.

For these and other reasons, there is a need for the present invention.

SUMMARY OF THE INVENTION

An inkjet printing system includes a platen adapted to support a print media, a printhead adapted to eject ink into a print zone between the printhead and the platen toward the print media and beyond a first edge of the print media to generate waste ink, a first absorber formed in the platen within the print zone such that the first absorber is adapted to extend beyond the first edge of the print media and absorb the waste ink ejected beyond the first edge of the print media, and a second absorber adapted to contact and absorb the waste ink from the first absorber, wherein the first absorber has a first capillary head and the second absorber has a second capillary head greater than the first capillary head.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
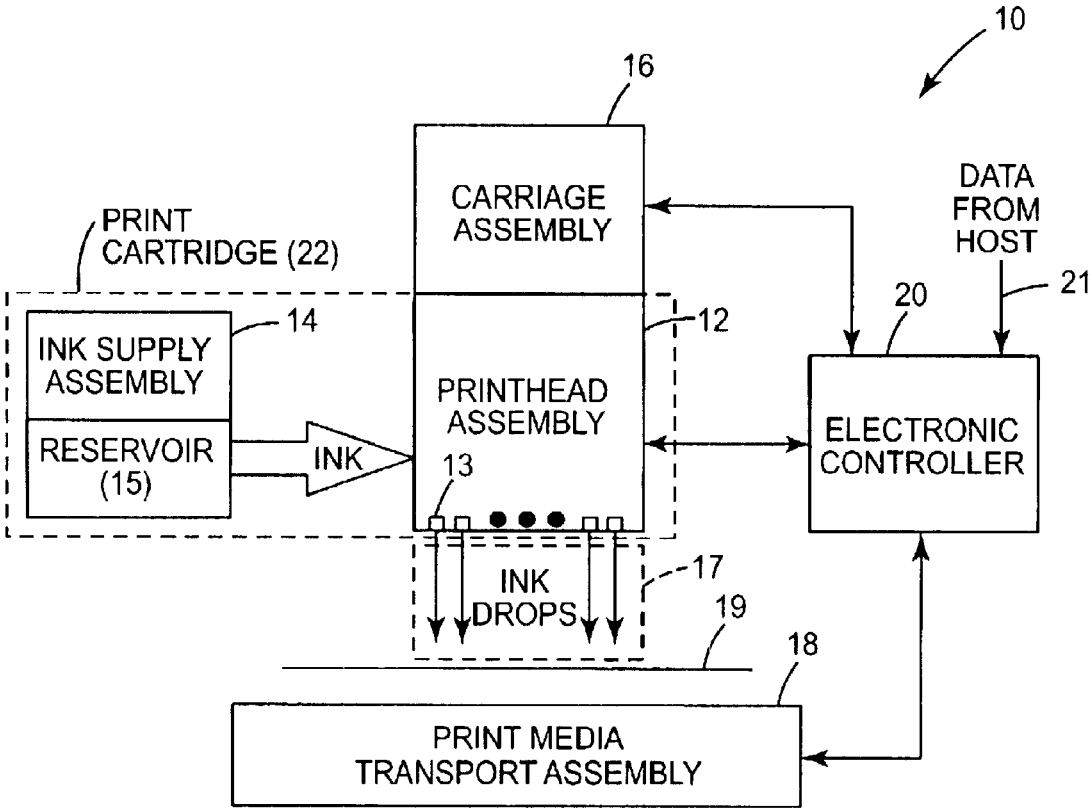
FIG. 1 is a block diagram illustrating one embodiment of an inkjet printing system according to the present invention.

FIG. 1 illustrates one embodiment of a portion of an inkjet printing system 10. Inkjet printing system 10 includes an inkjet printhead assembly 12, an ink supply assembly 14, a carriage assembly 16, a print media transport assembly 18, and an electronic controller 20. Inkjet printhead assembly 12 includes one or more printheads which eject drops of one or more colored inks through a plurality of orifices or nozzles 13. In one embodiment, a plurality of printheads are spaced apart and staggered such that adjacent printheads overlap. Thus, inkjet printhead assembly 12 may span a nominal page width or a width shorter or longer than nominal page width.

In one embodiment, the drops of ink are directed toward a medium, such as a print media 19, so as to print onto print media 19. Print media 19 includes any type of suitable sheet material, such as paper, card stock, envelopes, labels, transparencies, Mylar, and the like. Typically, nozzles 13 are arranged in one or more columns or arrays such that properly sequenced ejection of ink from nozzles 13 causes characters, symbols, and/or other graphics or images to be printed upon print media 19 as inkjet printhead assembly 12 and print media 19 are moved relative to each other.

Ink supply assembly 14 supplies ink to inkjet printhead assembly 12 and includes a reservoir 15 for storing ink. As such, in one embodiment, ink flows from reservoir 15 to inkjet printhead assembly 12. In one embodiment, inkjet printhead assembly 12 and ink supply assembly 14 are housed together in an inkjet print cartridge or pen, as identified by dashed line 22. In another embodiment, ink supply assembly 14 is separate from inkjet printhead assembly 12 and supplies ink to inkjet printhead assembly 12 through an interface connection, such as a supply tube.

Carriage assembly 16 positions inkjet printhead assembly 12 relative to print media transport assembly 18, and print media transport assembly 18 positions print media 19 relative to inkjet printhead assembly 12. As such, a print region 17 within which inkjet printhead assembly 12 deposits ink drops is defined adjacent to nozzles 13 in an area between inkjet printhead assembly 12 and print media 19. Print media 19 is advanced through print region 17 during printing by print media transport assembly 18.

Carriage assembly 16 typically includes a carriage and a carriage drive assembly. As such, inkjet printhead assembly 12 is removably mounted in, and supported by, the carriage, and the carriage drive assembly moves the carriage and, therefore, inkjet printhead assembly 12 relative to print media 19. A conventional carriage drive assembly may include a carriage guide which supports the carriage, a drive motor, and a belt and pulley system which moves the carriage along the carriage guide.

In one embodiment, inkjet printhead assembly 12 is a scanning type printhead assembly, and carriage assembly 16 moves inkjet printhead assembly 12 relative to print media transport assembly 18 and print media 19 during printing of a swath on print media 19. In another embodiment, inkjet printhead assembly 12 is a non-scanning type printhead assembly, and carriage assembly 16 fixes inkjet printhead assembly 12 at a prescribed position relative to print media transport assembly 18 during printing of a swath on print media 19 as print media transport assembly 18 advances print media 19 past the prescribed position.

Electronic controller 20 communicates with inkjet printhead assembly 12, carriage assembly 16, and print media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or photo to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
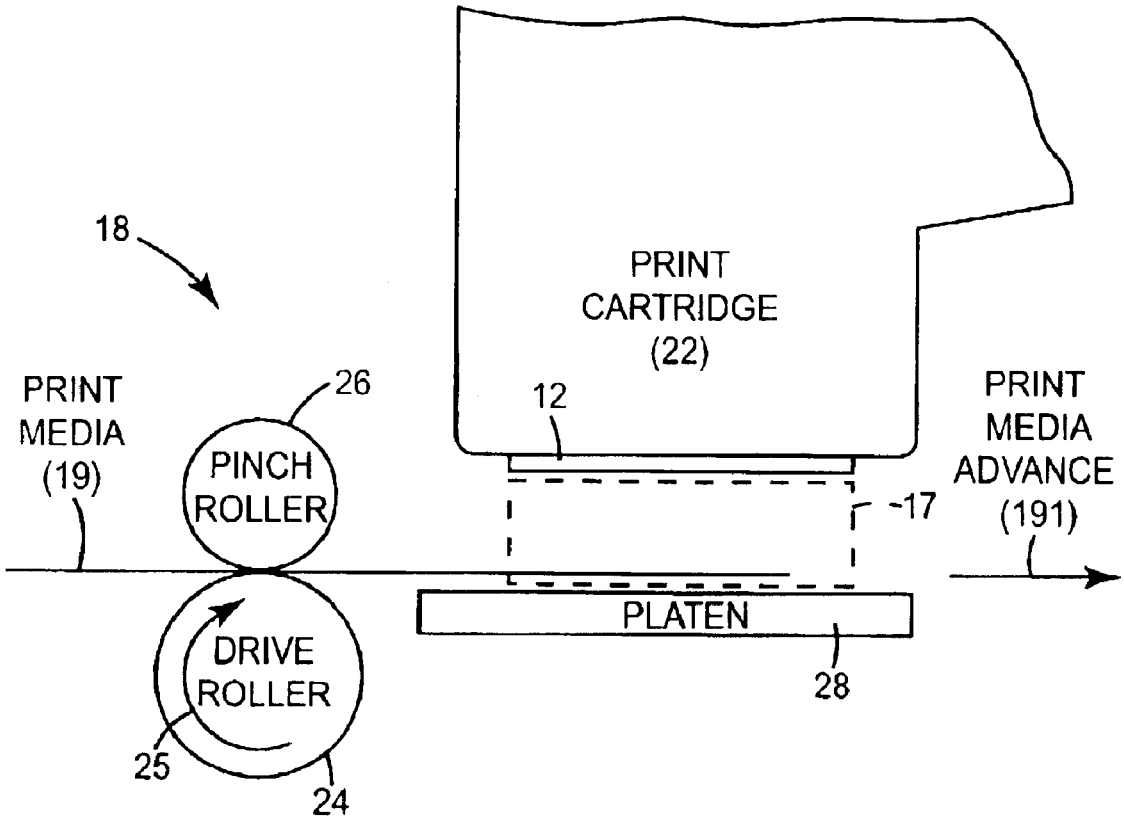
FIG. 2 is a schematic side view illustrating one embodiment of a portion of a print media transport assembly and a print cartridge according to the present invention.

FIG. 2 illustrates one embodiment of a portion of print media transport assembly 18 and print cartridge 22, including inkjet printhead assembly 12. Print media transport assembly 18 includes a drive roller 24, a pinch roller 26, and a platen 28. Drive roller 24 is rotatably mounted for rotation and driven in a direction indicated by arrow 25. Pinch roller 26 is mounted in an opposing relationship to drive roller 24 such that-a nip is formed between drive roller 24 and pinch roller 26. Platen 28 supports print media 19 as print media 19 is advanced through print region 17, as described below. During printing, print media 19 is advanced relative to inkjet printhead assembly 12 in a direction indicated by arrow 191.

Drive roller 24 and pinch roller 26 work in conjunction to advance print media 19 through print region 17. In one embodiment, print media 19 is fed into engagement between drive roller 24 and pinch roller 26 by a pick roller or other print media transport roller (not shown), as is well known in the art.

In a scanning type embodiment, once a desired portion of print media 19 reaches print region 17, print media 19 is held in position as print cartridge 22, including inkjet printhead assembly 12, traverses print media 19 in a direction substantially perpendicular to the direction of print media advance indicated by arrow 191 (i.e., in a direction in and out of the plane of the paper) to print on print media 19 and create a print swath on print media 19. Once print cartridge 22 has completed the print swath, print media 19 is advanced an incremental distance in the direction of print media advance indicated by arrow 191 to permit further printing on print media 19 and the creation of an additional print swath on print media 19. In one embodiment, print media 19 is supported by platen 28 as inkjet printhead assembly 12 prints on print media 19.

In a non-scanning type embodiment, inkjet printhead assembly 12 is held in a prescribed position relative to platen 28 as print media 19 is supported by platen 28 and advanced in the direction of print media advance indicated by arrow 191 to print on print media 19.

It is understood that FIG. 2 is a simplified schematic illustration of print media transport assembly 18. For example, the relative size and spacing of drive roller 24 and pinch roller 26 may vary in accordance with the present invention. In addition, an orientation of the opposing relationship of pinch roller 26 to drive roller 24 may vary. More specifically, a center of pinch roller 26 need not be directly above drive roller 24. Furthermore, multiple drive rollers 24 and/or multiple pinch rollers 26 each spaced in a direction substantially perpendicular to the direction of print media advance indicated by arrow 191 (i.e., in a direction in and out of the plane of the paper) may form print media transport assembly 18. In addition, the spacing between inkjet printhead assembly 12 and print media 19 has been exaggerated for clarity of the invention. Furthermore, it is understood that print media 19 contacts and is supported by platen 28.

In one embodiment, inkjet printing system 10 produces a borderless image on print media 19. More specifically, inkjet printing system 10 produces an image on print media 19 without one or more unprinted margins between the image and a corresponding edge of print media 19. An example of such an image includes a photograph.

Figure 3:
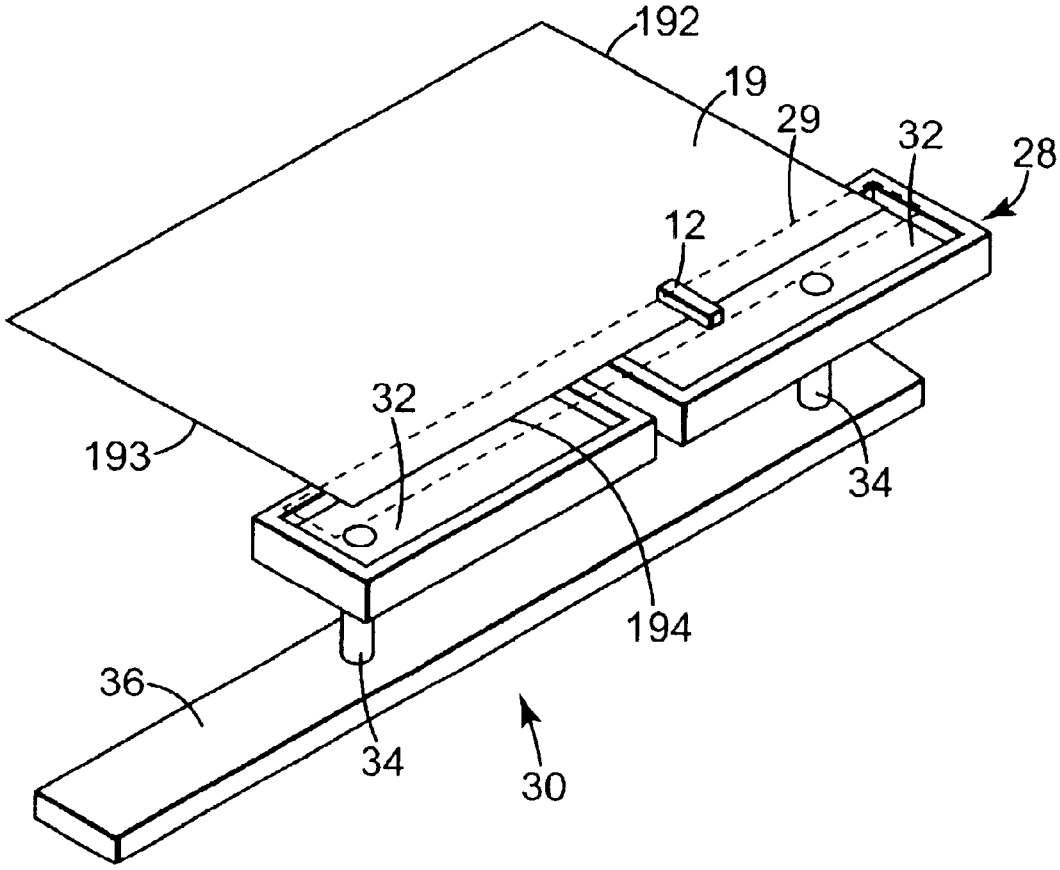
FIG. 3 is a perspective view illustrating a portion of an inkjet printing system including one embodiment of a waste ink absorption system according to the present invention.

As illustrated in the embodiments of FIGS. 2 and 3, inkjet printhead assembly 12 prints beyond one or more edges of print media 19 to produce a borderless image on print media 19. As such, when printing at or near the edges of print media 19, print region 17 extends beyond one or more edges of print media 19 between inkjet printhead assembly 12 and platen 28.

In one embodiment, as illustrated in FIG. 3, inkjet printhead assembly 12 prints beyond two opposing edges 192 and 193 of print media 19 and at least one edge 194 of print media 19 which is adjacent to opposing edges 192 and 193. Thus, a print zone 29 extends between inkjet printhead assembly 12 and platen 28 and across platen 28 so as to encompass all possible print regions of inkjet printhead assembly 12. Print zone 29, therefore, is defined to include that area into which inkjet printhead assembly 12 deposits ink drops during printing.

Figure 4:
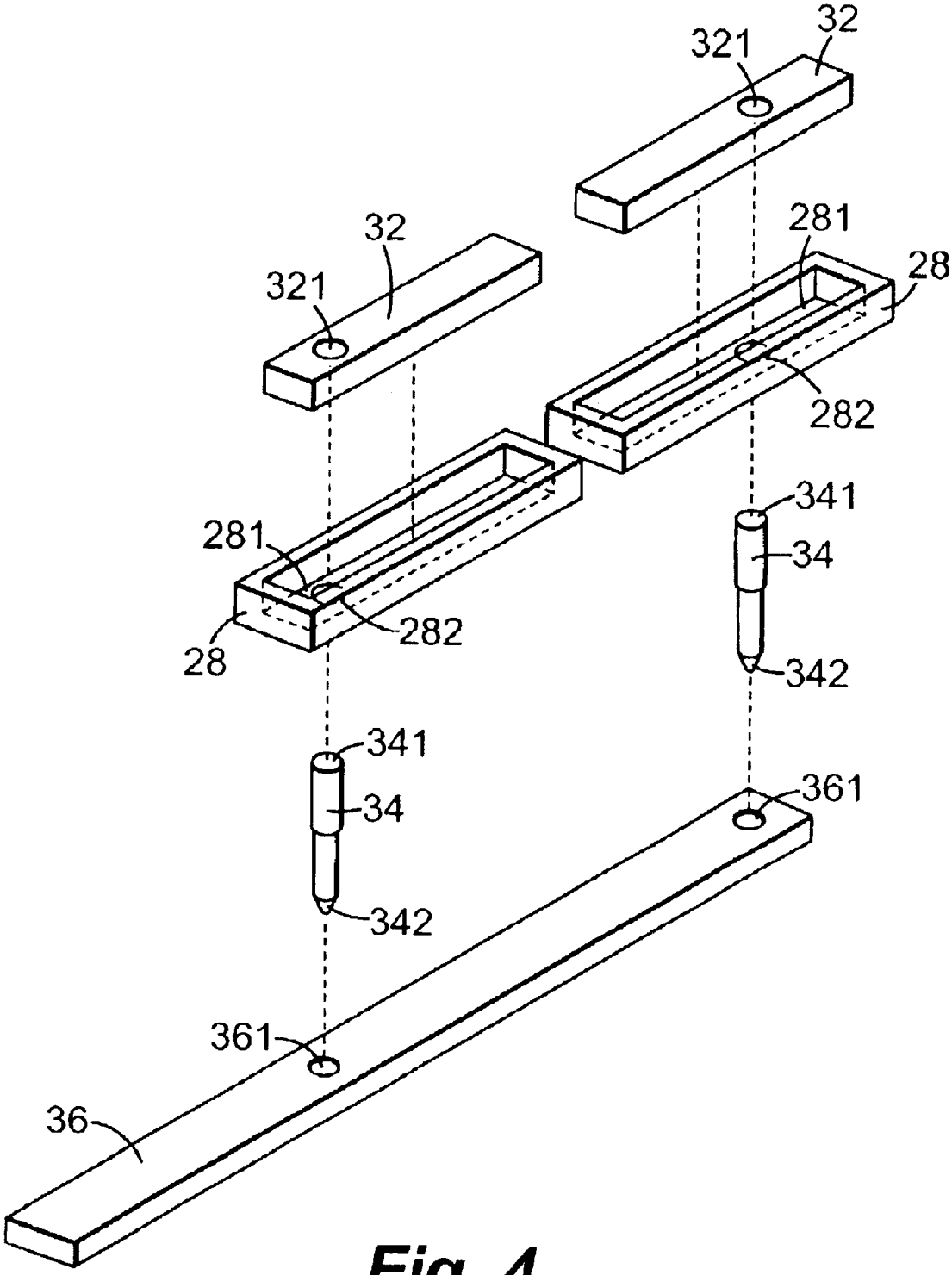
FIG. 4 is an exploded perspective view of the waste ink absorption system of FIG. 3.

In one embodiment, as illustrated in FIGS. 3 and 4, inkjet printing system 10 includes a waste ink absorption system 30. As inkjet printing system produces a borderless image on print media 19, overspray or waste ink is generated by ink drops ejected from inkjet printhead assembly 12 beyond the edges of print media 19. As such, waste ink absorption system 30 collects the waste ink.

As illustrated in the embodiment of FIGS. 3 and 4, waste ink absorption system 30 includes a print area absorber 32, at least one wick 34, and a storage reservoir 36. In one embodiment, print area absorber 32 is formed in a channel 281 of platen 28 and positioned within print zone 29. As such, print area absorber 32 collects overspray or waste ink generated during printing, as described above. Wick 34 extends through a hole 282 of platen 28 and contacts print area absorber 32. Wick 34 extends between print area absorber 32 and storage reservoir 36 so as to transfer the waste ink collected by print area absorber 32 to storage reservoir 36. As such, storage reservoir 36 accumulates and stores the waste ink collected by print area absorber 32. Storage reservoir 36, therefore, accumulates and stores the waste ink remote of print zone 29. Thus, print area absorber 32 forms a first absorber for waste ink, wick 34 forms a second absorber for waste ink, and storage reservoir 36 forms a third absorber for waste ink. As described below, print area absorber 32, wick 34, and storage reservoir 36 cooperate to transport the waste ink away from print zone 29.

In one embodiment, as illustrated in FIG. 4, print area absorber 32 has a hole 321 formed therein into which a first end 341 of wick 34 is inserted. Hole 321 is sized so as to ensure contact between print area absorber 32 and wick 34 when wick 34 is inserted. In addition, storage reservoir 36 has a hole 361 formed therein into which a second end 342 of wick 34 opposite first end 341 is inserted. Hole 361 is sized so as to ensure contact between storage reservoir 36 and wick 34 when wick 34 is inserted.

In the embodiment illustrated in FIGS. 3 and 4, waste ink absorption system 30 includes a pair of spaced print area absorbers 32 each positioned in spaced portions of platen 28 and includes a pair of spaced wicks 34 each contacting and extending between a respective print area absorber 32 and storage reservoir 36. It is, however, within the scope of the present invention for waste ink absorption system 30 to include a single print area absorber extending along platen 28 with one or more wicks 34 contacting and extending between print area absorber 32 and storage reservoir 36.

Waste ink absorption system 30 relies on capillary action to transport draw the waste ink away from print zone 29. Capillary action refers to the movement of a fluid in the interstices of a porous medium due to capillary forces. The potential that causes the fluid to flow or move by capillary action is referred to as capillary head.

To transport the waste ink away from print zone 29 and into storage reservoir 36, print area absorber 32, wick 34, and storage reservoir 36 have differing capillary heads. More specifically, print area absorber 32 has a low capillary head relative to wick 34 and storage reservoir 36, wick 34 has a medium capillary head relative to print area absorber 32 and storage reservoir 36, and storage reservoir 36 has a high capillary head relative to print area absorber 32 and wick 34. As such, print area absorber 32 has a first capillary head, wick 34 has a second capillary head which is greater than the first capillary head of print area absorber 32, and storage reservoir 36 has a third capillary head which is greater than the second capillary head of wick 34. Thus, a differential capillary pressure is created between print area absorber 32 and storage reservoir 36. Accordingly, print area absorber 32 collects the waste ink, wick 34 pulls or draws the waste ink from print area absorber 32, and storage reservoir 36 pulls or draws the waste ink from wick 34.

In one embodiment, the differing capillary heads of print area absorber 32, wick 34, and storage reservoir 36 are established by selecting and/or utilizing differing materials and/or material characteristics for print area absorber 32, wick 34, and storage reservoir 36. For example, in one illustrative embodiment, print area absorber 32 is formed of a polyester needle felt material which has coarse fibers, wick 34 is formed of a porous plastic material, and storage reservoir 36 is formed of a polyester needle felt material which has fine fibers.

In one illustrative embodiment, a capillary head of the material of print area absorber 32, wick 34, and storage reservoir 36 is specified based on a respective test coupon of each material which is one-half inch wide by at least six inches tall and subjected to a test duration of two hours at ambient conditions with a composite ink. In one illustrative embodiment, a capillary head of the material of print area absorber 32 under the above test conditions is in a range of approximately 60 millimeters to approximately 80 millimeters. In another illustrative embodiment, the capillary head of the material of print area absorber 32 under the above test conditions is approximately 70 millimeters. In one illustrative embodiment, a capillary head of the material of wick 34 under the above test conditions is in a range of approximately 90 millimeters to approximately 110 millimeters. In another illustrative embodiment, the capillary head of the material of wick 34 under the above test conditions is approximately 100 millimeters. In one illustrative embodiment, a capillary head of the material of storage reservoir 36 under the above test conditions is at least approximately 120 millimeters. In another illustrative embodiment, the capillary head of the material of storage reservoir 36 under the above test conditions is approximately 140 millimeters.

By collecting the waste ink with print area absorber 32 and pulling or drawing the waste ink from print area absorber 32 with wick 34, the possibility of the waste ink negatively affecting the quality of images produced with inkjet printing system 10 by, for example, the transfer of the waste ink to print media 19 is reduced with waste ink absorption system 30. In addition, with waste ink absorption system 30, the waste ink storage capacity of inkjet printing system 10 is increased. More specifically, by transferring the waste ink from print area absorber 32 to storage reservoir 36, waste ink absorption system 30 allows the transport and storage of waste ink vertically and/or horizontally away from print zone 29 to an area where additional waste ink storage capacity is available. In one illustrative embodiment, a capacity of storage reservoir 36 is in a range of approximately three times to approximately five times greater than a capacity of print area absorber 32. In another illustrative embodiment, the capacity of storage reservoir 36 is approximately four times greater than that of print area absorber 32. As such, with waste ink absorption system 30, more printing can be completed before the absorbers are full of waste ink.

By transferring the waste ink from print area absorber 32 to storage reservoir 36, minimal space is required to collect the waste ink in print zone 29. Thus, print area absorber 32 can be designed with limited capacity so as to reduce the quantity of waste ink in print zone 29. Furthermore, by creating a differential capillary pressure between print area absorber 32 and storage reservoir 36, waste ink can be drawn from print area absorber 32 such that print area absorber 32 can be kept as dry as possible.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printing system, comprising:

a platen adapted to support a print media;

a printhead adapted to eject ink into a print zone between the printhead and the platen toward the print media and beyond a first edge of the print media to generate waste ink;

a first absorber formed in the platen within the print zone, the first absorber adapted to extend beyond the first edge of the print media and absorb the waste ink ejected beyond the first edge of the print media; and a second absorber adapted to contact and absorb the waste ink from the first absorber, wherein the first absorber has a first capillary head and the second absorber has a second capillary head greater than the first capillary head.

2. The inkjet printing system of claim 1, wherein the printhead is adapted to eject ink beyond a second edge of the print media to generate the waste ink, and wherein the first absorber is adapted to extend beyond the second edge of the print media and absorb the waste ink ejected beyond the second edge of the print media.

3. The inkjet printing system of claim 2, wherein the second edge of the print media is one of adjacent and opposite the first edge of the print media.

4. The inkjet printing system of claim 2, wherein the printhead is adapted to eject ink beyond a third edge of the print media to generate the waste ink, and wherein the first absorber is adapted to extend beyond the third edge of the print media and absorb the waste ink ejected beyond the third edge of the print media.

5. The inkjet printing system of claim 4, wherein the third edge of the print media is adjacent the first edge and the second edge of the print media.

6. The inkjet printing system of claim 1, wherein the second absorber is adapted to draw the waste ink from the first absorber.

7. The inkjet printing system of claim 1, further comprising:

a third absorber adapted to contact and absorb the waste ink from the second absorber, wherein the third absorber has a third capillary head greater than the second capillary head.

8. The inkjet printing system of claim 7, wherein the third absorber is adapted to draw the waste ink from the second absorber.

9. The inkjet printing system of claim 7, wherein the first absorber is adapted to collect the waste ink, the second absorber is adapted to transfer the waste ink from the first absorber to the third absorber, and the third absorber is adapted to accumulate the waste ink.

10. The inkjet printing system of claim 7, wherein the first absorber, the second absorber and the third absorber are collectively adapted to transport the waste ink away from the print zone.

11. The inkjet printing system of claim 7, wherein a capacity of the third absorber is in a range of approximately three times to approximately five times a capacity of the first absorber.

12. The inkjet printing system of claim 1, wherein the printhead is a scanning printhead.

13. The inkjet printing system of claim 1, wherein the printhead is a non-scanning printhead.

14. A method of printing on a print media, the method comprising:

supporting the print media with a platen;

ejecting ink from a printhead into a print zone between the printhead and the platen toward the print media, including ejecting ink beyond a first edge of the print media and generating waste ink;

absorbing the waste ink with a first absorber formed in the platen within the print zone and extended beyond the first edge of the print media; and absorbing the waste ink from the first absorber with a second absorber contacting the first absorber, wherein the first absorber has a first capillary head and the second absorber has a second capillary head greater than the first capillary head.

15. The method of claim 14, wherein ejecting ink from the printhead includes ejecting ink beyond a second edge of the print media and generating the waste ink, and wherein absorbing the waste ink with the first absorber includes absorbing the waste ink with the first absorber extended beyond the second edge of the print media.

16. The method of claim 15, wherein the second edge of the print media is one of adjacent and opposite the first edge of the print media.

17. The method of claim 15, wherein ejecting ink from the printhead includes ejecting ink beyond a third edge of the point media and generating the waste ink, and wherein absorbing the waste ink with the first absorber includes absorbing the waste ink with the first absorber extended beyond the third edge of the print media.

18. The method of claim 17, wherein the third edge of the print media is adjacent the first edge and the second edge of the print media.

19. The method of claim 14, wherein absorbing the waste ink from the first absorber includes drawing the waste ink from the first absorber with the second absorber.

20. The method of claim 14, further comprising:

absorbing the waste ink from the second absorber with a third absorber contacting the second absorber, wherein the third absorber has a third capillary head greater than the second capillary head.

21. The method of claim 20, wherein absorbing the waste ink from the second absorber includes drawing the waste ink from the second absorber with the third absorber.

22. The method of claim 20, wherein absorbing the waste ink with the first absorber, absorbing the waste ink from the first absorber with the second absorber, and absorbing the waste ink from the second absorber with the third absorber includes collecting the waste ink with the first absorber, transferring the waste ink from the first absorber to the third absorber with the second absorber, and accumulating the waste ink in the third absorber.

23. The method of claim 20, wherein absorbing the waste ink with the first absorber, absorbing the waste ink from the first absorber with the second absorber, and absorbing the waste ink from the second absorber with the third absorber includes transporting the waste ink away from the print zone.

24. A waste ink absorption system for an inkjet printing system, the waste ink absorption system comprising:

a first absorber having a first capillary head, the first absorber adapted to absorb waste ink generated within a print zone of the inkjet printing system;

a second absorber having a second capillary head greater than the first capillary head, the second absorber adapted to contact the first absorber and absorb the waste ink from the first absorber; and a third absorber having a third capillary head greater than the second capillary head, the third absorber adapted to contact the second absorber and absorb the waste ink from the second absorber.

25. The waste ink absorption system of claim 24, wherein the second absorber is adapted to draw the waste ink from the first absorber and the third absorber is adapted to draw the waste ink from the second absorber.

26. The waste ink absorption system of claim 24, wherein the first absorber is adapted to collect the waste ink, the second absorber is adapted to transfer the waste ink from the first absorber to the third absorber, and the third absorber is adapted to accumulate the waste ink.

27. The waste ink absorption system of claim 24, wherein the first absorber is adapted to absorb the waste ink during printing.

28. The waste ink absorption system of claim 24, wherein the first absorber is positioned within the print zone of the inkjet printing system.

29. The waste ink absorption system of claim 24, wherein the first absorber, the second absorber, and the third absorber are collectively adapted to transport the waste ink away from the print zone.

30. The waste ink absorption system of claim 24, wherein the first absorber includes a polyester needle felt material having coarse fibers, the second absorber includes a porous plastic material, and the third absorber includes a polyester needle felt material having fine fibers.

31. The waste ink absorption system of claim 24, wherein, based on a one-half inch wide by at least six inch tall sample, the first capillary head of the first absorber is in a range of approximately 60 millimeters to approximately 80 millimeters, the second capillary head of the second absorber is in a range of approximately 90 millimeters to approximately 110 millimeters, and the third capillary head of the third absorber is at least approximately 120 millimeters.

32. A method of transporting waste ink in an inkjet printing system, the method comprising:

absorbing the waste ink within a print zone of the inkjet printing system with a first absorber having a first capillary head;

contacting the first absorber with a second absorber having a second capillary head greater than the first capillary head, including absorbing the waste ink from the first absorber with the second absorber; and contacting the second absorber with a third absorber having a third capillary head greater than the second capillary head, including absorbing the waste ink from the second absorber with the third absorber.

33. The method of claim 32, wherein absorbing the waste ink from the first absorber and absorbing the waste ink from the second absorber includes drawing the waste ink from the first absorber with the second absorber and drawing the waste ink from the second absorber with the third absorber.

34. The method of claim 32, wherein absorbing the waste ink with the first absorber, absorbing the waste ink from the first absorber with the second absorber, and absorbing the waste ink from the second absorber with the third absorber includes collecting the waste ink with the first absorber, transferring the waste ink from the first absorber to the third absorber with the second absorber, and accumulating the waste ink in the third absorber.

35. The method of claim 32, wherein absorbing the waste ink with the first absorber includes absorbing the waste ink during printing.

36. The method of claim 32, wherein absorbing the waste ink with the first absorber, absorbing the waste ink from the first absorber with the second absorber, and absorbing the waste ink from the second absorber with the third absorber includes transporting the waste ink away from the print zone.

37. A waste ink absorption system for an inkjet printer system, the waste ink absorption system comprising:

means for collecting waste ink generated by the inkjet printing system within a print zone of the inkjet printing system;

means for accumulating the waste ink remote from the print zone; and means for transferring the waste ink from the means for collecting the waste ink to the means for accumulating the waste ink, wherein means for collecting the waste ink includes a first material having a first capillary head, wherein means for transferring the waste ink includes a second material having a second capillary head greater than the first capillary head, and wherein means for accumulating the waste ink includes a third material having a third capillary head greater than the second capillary head.

* * * * *